US008276647B2

(12) United States Patent
Hohenbichler et al.

(10) Patent No.: US 8,276,647 B2
(45) Date of Patent: Oct. 2, 2012

(54) PROCESS AND APPARATUS FOR A COMBINED CASTING AND ROLLING INSTALLATION

(75) Inventors: Gerald Hohenbichler, Kronstorf (AT); Michael Jesche, Mödling (AT); Daniel Ness, Aschach (AT); Wolfgang Peitl, St. Florian (AT); Heinrich Puehringer, Gunskirchen (AT); Alois Seilinger, Linz (AT); Robert Andrew Shore, Pasching (AT)

(73) Assignee: Siemens Vai Metals Technologies GmbH (AT)

( * ) Notice: Subject to any disclaimer, the term of this patent is extended or adjusted under 35 U.S.C. 154(b) by 104 days.

(21) Appl. No.: 12/936,218

(22) PCT Filed: Mar. 4, 2009

(86) PCT No.: PCT/EP2009/052532

§ 371 (c)(1),
(2), (4) Date: Nov. 5, 2010

(87) PCT Pub. No.: WO2009/121678

PCT Pub. Date: Oct. 8, 2009

(65) Prior Publication Data

US 2011/0056649 A1 Mar. 10, 2011

(30) Foreign Application Priority Data

Apr. 4, 2008 (AT) ..... A 533/2008

(51) Int. Cl.
*B22D 11/12* (2006.01)
*B22D 11/126* (2006.01)
*B21B 1/46* (2006.01)

(52) U.S. Cl. ..... 164/460; 164/476; 164/263; 164/417; 29/527.6; 29/527.7

(58) Field of Classification Search ..... 164/460, 164/476, 263, 269, 417; 29/527.6, 527.7
See application file for complete search history.

(56) References Cited

U.S. PATENT DOCUMENTS 5,490,315 A * 2/1996 Kostopolos et al. ..... 29/527.7
(Continued)

FOREIGN PATENT DOCUMENTS

AU 675099 B2 2/1994
(Continued)

OTHER PUBLICATIONS

International Search Report dated May 13, 2009, issued in corresponding international application No. PCT/EP2009/052532.

*Primary Examiner* — Kevin P Kerns
(74) *Attorney, Agent, or Firm* — Ostrolenk Faber LLP

(57) ABSTRACT

A method and an apparatus for producing hot-rolled products in a combined casting-rolling installation. A method and a combined casting-rolling installation with which an uninterrupted continuous casting process can be maintained not only when there is a planned interruption to production but also when there is an unplanned interruption to production, occurring for example in a heating zone, a finishing mill train, a cooling zone or a storage device. These method steps are carried out to bridge an interruption in production in the part of the installation that is downstream of the cutting-up and delivering device (6): a) cutting off a strand portion (21) of the continuously produced preliminary material (3) by means of a first shears (9); b) raising the tail part of the strand portion (21) from the roller table (4) by means of a raising device (11); c) breaking up the preliminary material (3) passing the first shears (9) into pieces of scrap (19) by means of the first shears (9) into pieces of scrap (19) by means of the first shears (9), delivering the pieces of scrap (19) and removing the strand portion (21) unit the operational readiness of the combined casting-rolling installation is restored.

15 Claims, 2 Drawing Sheets

U.S. PATENT DOCUMENTS

| | | | | |
|---|---|---|---|---|
| 6,240,763 | B1 * | 6/2001 | Benedetti | 72/239 |
| 6,647,604 | B2 | 11/2003 | Sclippa | |
| 2001/0011565 | A1 * | 8/2001 | Arvedi | 148/546 |

FOREIGN PATENT DOCUMENTS

| | | | |
|---|---|---|---|
| DE | 3803592 | A1 | 8/1989 |
| DE | 3830027 | A1 | 3/1990 |
| DE | 19639298 | A1 | 3/1998 |
| EP | 0611610 | A | 8/1994 |
| EP | 0761327 | A | 3/1997 |
| EP | 1240954 | A | 3/1997 |
| EP | 0860215 | A | 8/1998 |
| JP | 01-224102 | A | 9/1989 |
| WO | WO 00/71272 | A | 11/2000 |

* cited by examiner

PROCESS AND APPARATUS FOR A COMBINED CASTING AND ROLLING INSTALLATION

CROSS REFERENCE TO RELATED APPLICATION(S)

The present application is a 35 U.S.C. §371 National Phase conversion of PCT/EP2009/052532, filed Mar. 4, 2009, which claims benefit of Austrian Application No. A533/2008, filed Apr. 4, 2008, the contents of which are incorporated herein by reference. The PCT International Application was published in the German language.

BACKGROUND OF THE INVENTION

The present invention relates to a process and an apparatus for producing hot-rolled products in a combined casting and rolling installation.

Specifically, the invention relates to a process for producing hot-rolled products in a combined casting and rolling installation, wherein a continuously cast precursor material is transported in uncut form, i.e. as a billet, to a rolling mill train, where it is rolled, then cooled, cut up and stored.

Combined casting and rolling installations for implementing this process substantially comprise a casting installation, a roller table, a rolling installation suitable for direct use on cast products, a cooling section and a storage apparatus (e.g. a winding apparatus for flat products, a laying apparatus for wires or an outlet region for long products).

In order to be able to maintain the continuous operation of the continuous casting installation in the event of planned interruptions to production, e.g. in the event of a roller change or maintenance work, WO 00/71272 A1 proposes that it is possible either a) to sever the billet of the continuously produced precursor material and increase the rolling speed; or b) to sever the billet and reduce the casting speed; or c) the billet is cut up into billet portions which are then removed.

The process known from WO 00/71272 A1 is unsuitable for unplanned interruptions to production, e.g. if there is a fault in the heating section, the cooling section or the storage device or in the event of an emergency stop in the finishing rolling mill train, since a collision between the continuously produced precursor material and the severed billet portion cannot be avoided. In the event of an unplanned interruption to production, the continuous casting process therefore also has to be interrupted further.

SUMMARY OF THE INVENTION

It is an object of the invention to provide a process and a combined casting and rolling installation of the type mentioned in the introduction, with which it is possible to maintain the uninterrupted continuous casting process not only in the event of a planned interruption to production but also in the event of an unplanned interruption to production, which occurs, by way of example, in a heating section, a finishing rolling mill train, a cooling section or a storage apparatus.

This object is achieved by a process in which an interruption to production in a part of the installation downstream from the cutting-up and discharging device is bridged by carrying out the following process steps:

a) a billet portion of the continuously produced precursor material is cut off by means of first shears;

b) the tail part of the billet portion is raised from the roller table by means of a raising apparatus;

c) the precursor material passing the first shears is broken up into pieces of scrap by means of the first shears, the pieces of scrap are discharged and the billet portion is removed until the operational readiness of the combined casting and rolling installation is restored.

The material which is continuously produced and possibly rough-rolled by a continuous casting installation is referred to as precursor material. The severed part of the billet of the continuously produced precursor material is referred to in this document as billet portion. The pieces of precursor material broken up by the first shears and discharged are referred to as pieces of scrap. The interruptions to production mentioned may preferably be unplanned interruptions, e.g. emergency stops, but may also be planned interruptions for upgrading, repair or maintenance work, which occur in a part of the installation downstream from the cutting-up and discharging device. The precursor material is broken up into pieces and the pieces of scrap are discharged until either material no longer passes the first shears or the interruption to production ends, i.e. the operational readiness of the combined casting and rolling installation has been restored. Before normal operation of the combined casting and rolling installation is resumed, it must be ensured that the billet portion cut off is removed and the raising apparatus is lowered again.

In an embodiment of the process which is advantageous for collision-free operation of the installation, the billet portion of the continuously produced precursor material is cut off by means of the first shears at the same time as or immediately after production is interrupted. Cutting off is regarded as having taken place immediately after the interruption to production if the raising of the raising apparatus was initiated substantially after a short time period, containing the signal propagation times from a sensor to the control means and from the control means to the raising apparatus, and also the reaction time of the control means.

The tail part of the billet portion is advantageously raised by means of the raising apparatus immediately after the billet portion is cut off, and this ensures that the billet portion cut off and the continuously produced precursor material cannot collide.

The pieces of scrap are advantageously discharged into a lowerable roller table downstream from the first shears and are removed until the operational readiness of the combined casting and rolling installation is restored. Care must be taken to ensure that the lowerable roller table is raised again before normal operation of the combined casting and rolling installation is resumed. It goes without saying that the pieces of scrap can also be discharged from the roller table into an external storage area by means of a transverse conveying device.

The process according to the invention has a particularly advantageous configuration if the precursor material is cut up into precursor product portions by second shears, which are situated upstream from the first shears, at the same time as or after the billet portion is cut off, and these precursor product portions are discharged by means of a discharging apparatus situated between the second shears and the first shears. The precursor material portions discharged in this way have a defined length, for example 8 to 14 m, are referred to as precursor product portions and can be subjected, by way of example, to subsequent machining in an external rolling mill train. The precursor material is cut up and the precursor product portions are discharged until the operational readiness of the combined casting and rolling installation is restored.

Precursor product portions are advantageously discharged by means of the discharging apparatus by the precursor product portions being raised from the roller table, transported to a stacking apparatus and lowered into a stacking apparatus.

In order to make it easier to discharge precursor product portions without collisions occurring, it is advantageous to accelerate the precursor product portions on the roller table by means of motor-driven rollers or driving rollers, before they are discharged in the discharging apparatus. This creates a gap between the subsequent precursor material and the precursor product portion.

In a further advantageous embodiment, in the case of large overall thickness changes between the continuously cast precursor material and the end product, the process is carried out in such a manner that the precursor material is rough-rolled in a single-stand or multi-stand rough-rolling mill train without additional heating, i.e. with the casting heat from the continuous casting process, after it has fully solidified. In this case, the continuously cast precursor material is rolled in a rough-rolling mill train downstream from the continuous casting installation, it also being possible in this embodiment variant to obtain large thickness changes in the rough-rolling mill train, particularly if a so-called high-reduction mill is used, without additional heating of the rolling stock.

A reduction in the transportation speed of the continuously cast precursor material at the same time as or immediately after production is interrupted or the billet portion is cut off with the first shears may be advantageous for various reasons. This can firstly be the case if the pieces of scrap or the precursor product portions are not expected to be utilized commercially. This can also be the case if the second shears are designed as pendulum shears; these possibly only function reliably at relatively low transportation speeds, but it is desirable to start discharging precursor product portions as soon as possible.

The transportation speed of the precursor material is reduced in a particularly advantageous manner by the opening up of one or more stands of the rough-rolling mill train.

Furthermore, the transportation speed of the precursor material can also be reduced by a reduction in the casting speed of the continuously operating continuous casting installation. This measure is particularly expedient when the precursor material is not rough-rolled and/or commercial utilization of the precursor material cannot be expected.

The process according to the invention also proves to be advantageous during start-up of the combined casting and rolling installation. In this respect, a start-up billet is introduced into the continuous casting installation and is moved concomitantly with the integrally cast billet. The head of the start-up billet together with part of the continuously cast precursor material is severed by one of the shears (the first shears or the second shears) and removed in the region of the discharging apparatus.

It is also advantageous that a wedge piece produced during start-up of the rough-rolling mill train on the continuously cast precursor material is severed or broken up into pieces by the second shears and removed in the region of the discharging apparatus. By way of example, a wedge piece is produced during adjustment of the working rollers of the rough-rolling mill train to the operating roller thickness or as a result of a particular operation of the continuous casting installation.

Depending on the temperature and the transportation speed of the precursor material, the layout of the installation and the specific requirements on the end product (e.g. the properties of the microstructure), it may be advantageous that the temperature of the uncut precursor material is set to rolling temperature by means of a heating section before rolling in the finishing rolling mill train.

In order to make it possible to implement the process according to the invention, which solves the object on which the invention is based, as directly as possible, it is advantageous that a cutting-up and discharging device comprises first shears and, downstream therefrom, a lowerable roller table and a raising apparatus. This embodiment of the cutting-up and discharging device makes it possible to cut the precursor material up into pieces of scrap and discharge these from the installation. In a particularly concise embodiment, the raising apparatus can be countersunk in the lowerable roller table.

The cutting-up and discharging device is particularly advantageously designed in such a manner that second shears are situated upstream from the first shears and a discharging apparatus is situated between the second shears and the first shears. It is thereby possible to cut the precursor material up into precursor product portions, discharge these from the installation and supply them, if appropriate, for residual use.

In the case of large overall thickness changes between the continuously cast precursor material and the end product, a single-stand or multi-stand rough-rolling mill train is advantageously situated between the continuous casting installation and the cutting-up and discharging device.

A heating section and a de-scaling installation, which possibly adjoins the latter, are expediently situated upstream from a single-stand or multi-stand finishing rolling mill train.

A tail part of a billet portion cut off can then be raised from the roller table in a particularly rapid and advantageous manner if the raising apparatus is designed as a hydraulically driven jib.

In order to keep the extent to which the precursor material cools down as it passes through the cutting-up and discharging device as small as possible, and to thereby carry along as much casting heat as possible from a continuous casting installation into a rolling mill train, it is advantageous to assign a housing to the discharging apparatus.

In order to accelerate the transportation of the precursor material in the region of the first shears and/or the second shears, and to thereby obtain a temporal gap between successive precursor product portions or pieces of scrap, it is advantageous that motor-driven rollers or driving rollers are respectively situated upstream and/or downstream from the first shears and/or the second shears.

It is also particularly advantageous to design the first shears as drum shears and/or the second shears as pendulum shears.

With regard to the type of installation for the heating section, it is advantageous to design the heating section as a tunnel heating section with induction heating.

Further advantages and features of the present invention will become apparent from the description which follows of non-limiting exemplary embodiments, reference being made to the figures.

DESCRIPTION OF PREFERRED EMBODIMENTS

Figure 1:
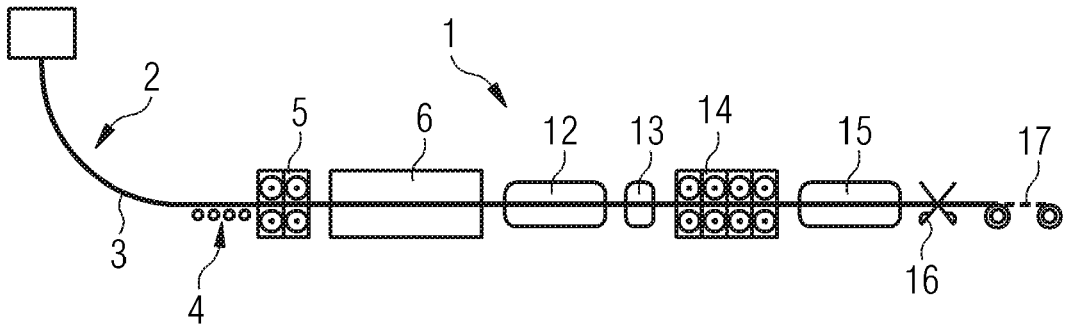
FIG. 1 is a schematic illustration of a combined casting and rolling installation for the fully continuous endless operation according to the invention.

FIG. 1 shows a combined casting and rolling installation 1. In normal operation, a continuous casting installation 2 produces a continuously cast precursor material 3, which is transported to a rough-rolling mill train 5 by means of a roller table 4. After it has been rough-rolled in the rough-rolling mill train 5, the precursor material 3 passes through a cutting-up and discharging device 6 in uncut form, i.e. as a billet, before the temperature of the precursor material is set to rolling temperature in a heating section 12. After the precursor material has been treated in a de-scaling installation 13, which is upstream from a finishing rolling mill train 14, the de-scaled precursor material is rolled in the single-stand or multi-stand finishing rolling mill train 14. The finish-rolled material is then cooled in a cooling section 15, cut to a defined product length or a defined product weight by shears 16 and then wound up by means of a storage apparatus 17 designed as a winding apparatus.

Figure 2:
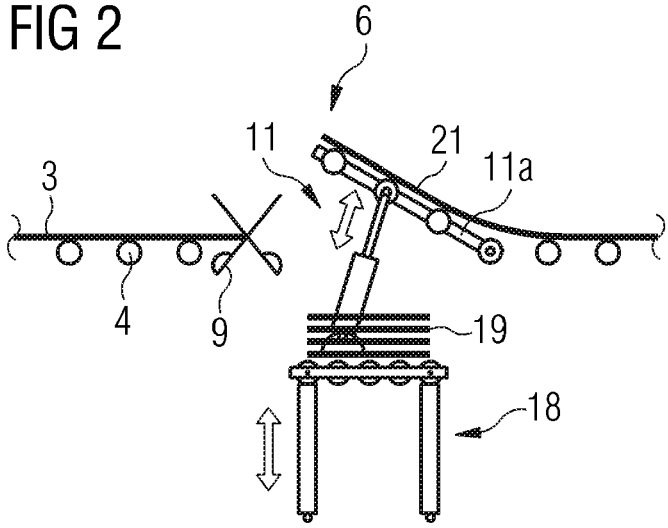
FIGS. 2 and 3 are schematic illustrations of two embodiments of a cutting-up and discharging device according to the invention.

FIG. 2 shows in more detail an embodiment according to the invention of the cutting-up and discharging device 6, comprising first shears 9, a lowerable roller table 18 and a raising apparatus 11. After a planned or unplanned interruption to production has arisen in a part of the installation downstream from the cutting-up and discharging device 6, the following process steps are carried out in the cutting-up and discharging device 6:

a) A billet portion 21 of the continuously produced precursor material 3 is cut off by means of the first shears 9, which are designed as drum shears. The billet portion is cut off at the same time as or immediately after production is interrupted.

b) The tail part of the billet portion 21 cut off is raised from the roller table 4 in the region downstream from the first shears 9 by means of the raising apparatus 11, which is designed as a hydraulically driven jib. In this case, only the billet portion 21 is raised after it has been cut off, and therefore the billet portion 21 and the subsequent precursor material 3 cannot collide. The jib 11*a* of the raising apparatus 11 is shown in the raised position.

c) The precursor material 3 passing the first shears 9 is broken up into pieces of scrap 19 and the pieces of scrap 19 are discharged into the lowerable roller table 18. Depending on how many pieces of scrap are discharged, the lowerable roller table is lowered by lifting elements (designed as hydraulic or pneumatic cylinders or electrical lifting spindle drives). The lowerable roller table 18 is shown in the lowered position. Before normal operation of the combined casting and rolling installation is resumed, it must be ensured that the pieces of scrap 19 are removed from the lowerable roller table 18, for example by means of a crane or similar equipment, and the billet portion 21 is removed. Furthermore, the raising apparatus 11 has to be lowered and the lowerable roller table 18 has to be raised.

Figure 3:
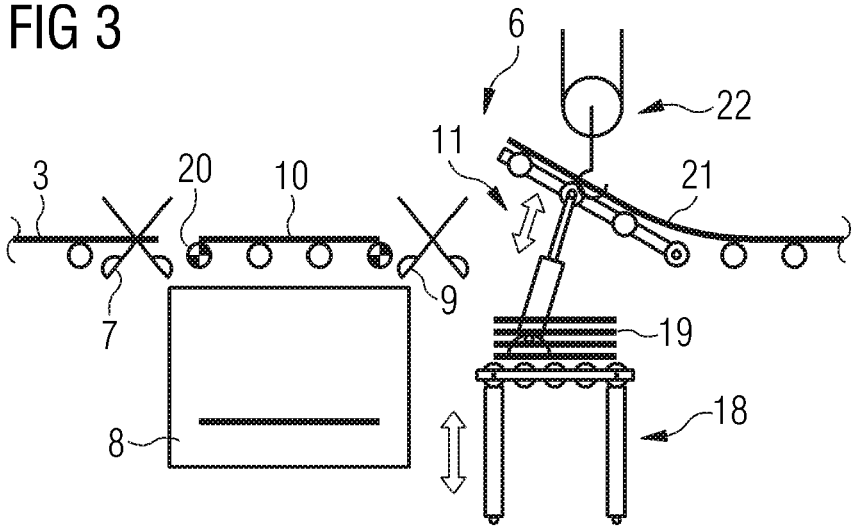

FIG. 3 shows in more detail a further embodiment according to the invention of the cutting-up and discharging device 6, comprising second shears 7, a discharging apparatus 8, first shears 9, a lowerable roller table 18 and a raising apparatus 11. In this case, the precursor material 3 is cut up into precursor product portions 10 of a defined length, for example into pieces having a length of 8 to 14 m, by second shears 7, which are situated upstream from the discharging apparatus 8 and are designed as pendulum shears, at the same time as or after working step a (cutting-off of the billet portion 21) described in relation to FIG. 2, and the precursor product portions 10 produced are discharged by means of a discharging apparatus 8. Working steps b and c (raising the billet portion, breaking into pieces and discharging pieces of scrap) are carried out in the manner already described in relation to FIG. 2. The transportation speed of the precursor material 3 is reduced at the same time as or immediately after the billet portion 21 is cut off. This takes place either by the opening up of one or more stands of the rough-rolling mill train or by a reduction in the casting speed of the continuously operating continuous casting installation. At least individual rollers of the roller table upstream and/or downstream from the first shears 9 and/or the second shears 7 are designed as motor-driven rollers or as so-called driving rollers 20. By means of these rollers, it is firstly possible to transport a precursor product portion 10 rapidly from the second shears 7 to the discharging apparatus 8 (create a gap between the subsequent precursor material 3 and the precursor product portion 10 to facilitate collision-free discharging), but it is also possible on the other hand to transport the precursor material cut off by the second shears 7 rapidly to the first shears 9 (for breaking up into pieces of scrap). Before normal operation of the combined casting and rolling installation is resumed, it must be ensured that the pieces of scrap 19 are removed from the lowered roller table, for example by means of a crane or similar equipment, and that the billet portion 21 is likewise removed, for example by means of a crane 22. Furthermore, the raising apparatus 11 has to be lowered and the lowerable roller table 18 has to be raised again.

Figure 4:
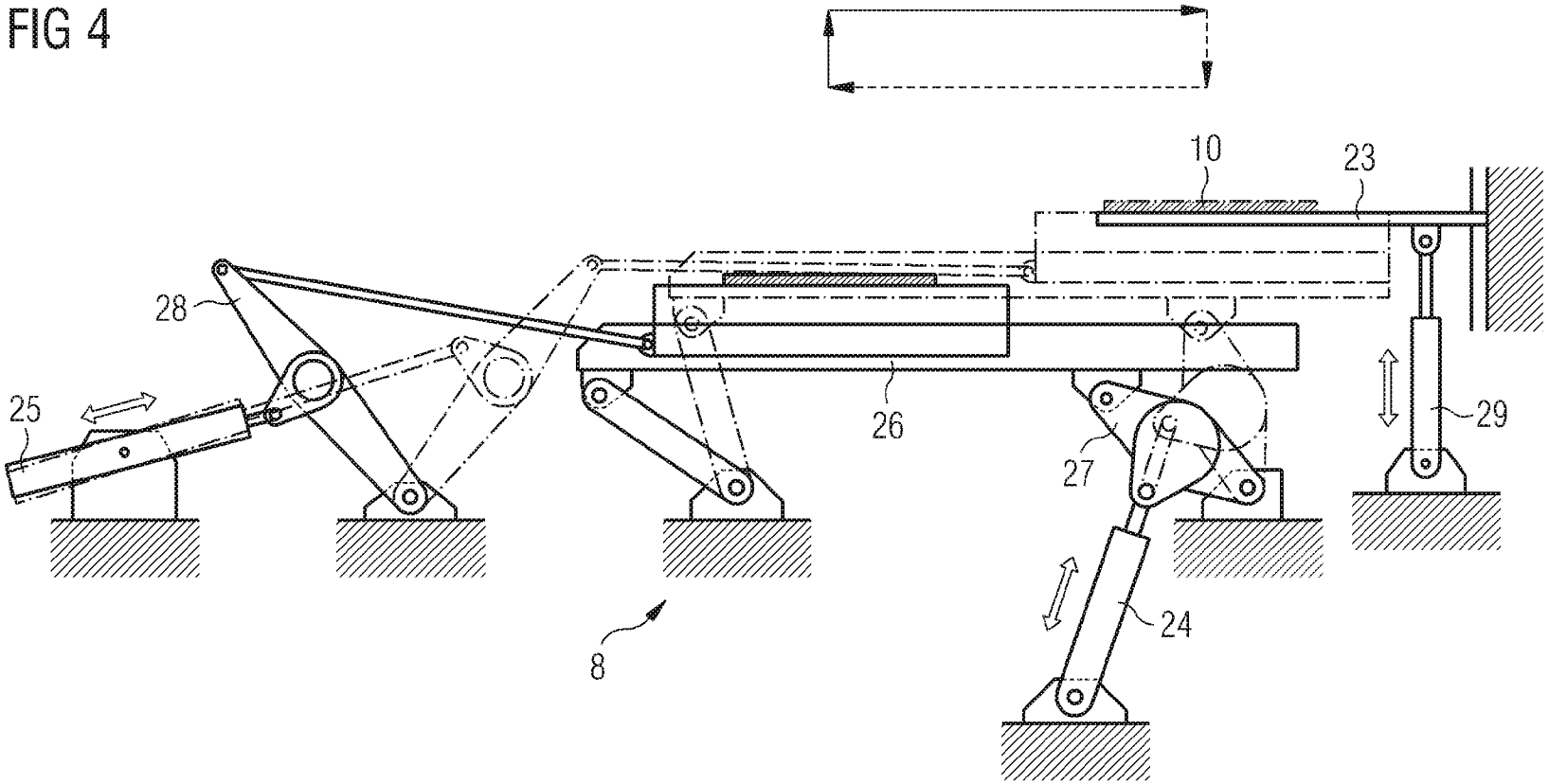
FIG. 4 is a schematic illustration of a discharging apparatus according to the invention.

FIG. 4 shows the discharging apparatus 8 in more detail. A lifting cylinder 24 and a displacement cylinder 25 make it possible to lift up a precursor product portion 10 from a roller table (not shown in more detail) using a transport platform 26, to transport it to a stacking apparatus 23 and to set it down there. In this context, the lifting cylinder 24 is connected to the transport platform 26 via a pivot lever 27 and is primarily responsible for the lifting operation. The displacement cylinder 25 is likewise connected to the transport platform 26 via a pivot lever 28 and a linkage and is primarily responsible for the displacement operation. The cyclic sequence of movement of the transport platform 26 (continuous lines show the initial position, dashed lines show the end position) and the transportation route of the precursor product portion 10 transported thereby are denoted by arrows in the movement diagram. The stacking apparatus 23 comprises a set-down platform, which can be adjusted vertically by means of a lifting element 29 (designed as a hydraulic or pneumatic cylinder or electrical lifting spindle drive). It is thereby possible to stack a plurality of precursor product portions one on top of another and thus in a manner which saves a large amount of space.

The invention claimed is:

1. A process for producing hot-rolled products in a combined casting and rolling installation comprising:

passing a billet of a continuously cast precursor material over a roller table and then after the billet has fully solidified through a cutting-up and discharging device at a transportation speed in uncut form, then rolling the billet in a finishing rolling mill train, then cooling the billet, cutting up the billet and storing the billet, upon an interruption of the producing in a part of the installation downstream in the passing from the cutting-up and discharging device, bridging by the following process steps:

a) cutting off a billet portion of the continuously produced precursor material;

b) raising a tail part of the cut off billet portion from the roller table;

c) passing the precursor material past a first shears and there breaking up the material into pieces of scrap by the first shears, discharging the pieces of scrap and removing the billet portion until operational readiness of the combined casting and rolling installation is restored.

2. The process as claimed in claim 1, wherein the cutting off of the billet portion of the continuously produced precursor material by the first shears is at the same time as or immediately after continuous production is interrupted.

3. The process as claimed in claim 1, wherein the raising of the tail part of the billet portion by the raising apparatus is immediately after the billet portion is cut off.

4. The process as claimed in claim 1, further comprising: discharging the pieces of scrap onto a lowerable roller table and removing the pieces until the operational readiness of the combined casting and rolling installation is restored.

5. The process as claimed in claim 1, further comprising: cutting up the precursor material into precursor product portions by second shears, which are situated upstream from the first shears, at the same time as or after the billet portion is cut off, and discharging the cut up precursor product portions by a discharging apparatus situated between the second shears and the first shears.

6. The process as claimed in claim 5, further comprising: the discharging of the precursor product portions by the discharging apparatus comprises raising the portions from a roller table, transporting the portions to a stacking apparatus and lowering the portions.

7. The process as claimed in claim 6, wherein before the precursor product portions are discharged by the discharging apparatus, accelerating the portions on the roller table by motor-driven rollers or driving rollers of the table.

8. The process as claimed in claim 5, further comprising: introducing a start-up billet into the continuous casting installation during a start-up of the combined casting and rolling installation, moving the start-up billet concomitantly with the integrally cast billet of precursor material, severing a head of the start-up billet together with a part of the continuously cast precursor material by one of the first and second shears and removing the severed head and the part of the precursor material in a region of the discharging apparatus.

9. The process as claimed in claim 1, further comprising after the continuously cast precursor material has fully solidified, rough rolling the continuously cast precursor material in a single-stand or multi-stand rough-rolling mill train without heating in addition to casting heat from the continuous casting process.

10. The process as claimed in claim 9, further comprising: producing a wedge piece on the continuously cast precursor material during start-up of a rough-rolling mill train, severing or breaking up the wedge into pieces by the second shears and removing the pieces in the region of the discharging apparatus.

11. The process as claimed in claim 1, further comprising: reducing a transportation speed of the passing of the continuously cast precursor material at the same time as or immediately after production of the material is interrupted or the billet portion is cut off with the first shears.

12. The process as claimed in claim 11, further comprising: reducing the transportation speed of the precursor material by opening up of one or more stands of a rough-rolling mill train passed by the material.

13. The process as claimed in claim 11, further comprising: reducing the transportation speed of the precursor material by reducing the casting speed of a continuously operating continuous casting installation.

14. The process as claimed in claim 1, further comprising: setting the temperature of the uncut precursor material to a rolling temperature by a heating section before rolling the material in the finishing rolling mill train.

15. The process as claimed in claim 1, wherein the billet portion of the continuously produced precursor material is cut off by first shears and the tail part of the billet portion is raised by a raising apparatus.

* * * * *